US011643830B2

(12) United States Patent
Comber

(10) Patent No.: US 11,643,830 B2
(45) Date of Patent: May 9, 2023

(54) ANCHORAGE TEMPLATE FOR BUILDING WALLS AND METHOD

(71) Applicant: Project Frog, Inc., San Francisco, CA (US)

(72) Inventor: Matthew V. Comber, San Francisco, CA (US)

(73) Assignee: Project Frog, Inc., San Francisco, CA (US)

( * ) Notice: Subject to any disclaimer, the term of this patent is extended or adjusted under 35 U.S.C. 154(b) by 147 days.

(21) Appl. No.: 16/903,379

(22) Filed: Jun. 17, 2020

(65) Prior Publication Data

US 2021/0395997 A1 Dec. 23, 2021

(51) Int. Cl.
*E04G 13/00* (2006.01)
*E04B 1/26* (2006.01)

(52) U.S. Cl.
CPC ..... *E04G 13/00* (2013.01); *E04B 1/2604* (2013.01); *E04B 2001/268* (2013.01)

(58) Field of Classification Search
CPC . E04G 13/00; E04G 21/185; E04B 2001/268; E04B 1/2604
USPC ..... 249/34; 52/699, 700, 701, 741.15, 52/745.21, 293.3, 274, 220.1, 220.8
See application file for complete search history.

(56) References Cited

U.S. PATENT DOCUMENTS 1,329,362 A * 2/1920 Bowe ..... B28B 7/0029 249/34
1,622,962 A * 3/1927 Michod ..... E04B 1/10 52/693
2,451,595 A * 10/1948 Wheeler ..... B25H 7/04 101/328
2,511,829 A * 6/1950 Arrighini et al. ..... E04G 9/08 249/34
2,689,987 A * 9/1954 Berger ..... E04B 1/0007 52/509
2,883,852 A * 4/1959 Midby ..... E04B 1/04 52/274
2,966,708 A * 1/1961 Freeman, Jr. ..... E04B 2/56 52/696

(Continued)

FOREIGN PATENT DOCUMENTS

EP 1122372 A1 * 8/2001 ..... E04B 1/2604

*Primary Examiner* — Michael Safavi

(74) *Attorney, Agent, or Firm* — Haynes and Boone, LLP

(57) ABSTRACT

A sill plate anchorage assembly for supporting prefabricated building walls includes an elongated member having spaced holes. A concrete formwork defines a space for receiving concrete to form a foundation to support the elongated member. The elongated member may be supported temporarily from the formwork. Anchor shafts extend within each of the spaced holes and extend below the elongated member into the space defined by the concrete formwork. After forming and curing the concrete, nuts or other fasteners are tightened over the upper ends of the anchor shafts to secure the elongated member against the foundation. The upper portions of the spaced holes may include enlarged recesses for receiving the fasteners. Indicia marked upon the elongated member may show the location and type of pass-through regions. A method to secure a horizontal sill plate to an underlying concrete foundation to support vertical building wall panels is also disclosed.

9 Claims, 6 Drawing Sheets

(56) References Cited

U.S. PATENT DOCUMENTS 3,333,388 A * 8/1967 Sandin ..... E04B 1/4121 52/704
3,334,455 A * 8/1967 Russell ..... E04B 1/0007 411/116
3,397,494 A 8/1968 Waring
3,500,607 A * 3/1970 Herberts ..... E04B 1/4164 52/99
3,894,368 A * 7/1975 Crofoot ..... E04G 15/061 52/704
4,817,353 A * 4/1989 Woods ..... E02D 27/00 52/741.15
5,010,711 A * 4/1991 Batio ..... E04B 1/0007 52/741.15
5,664,389 A * 9/1997 Williams ..... E04H 9/14 52/712
6,120,723 A 9/2000 Butler
6,298,619 B1 * 10/2001 Davie ..... E04B 7/22 52/270
6,308,469 B1 * 10/2001 Leung ..... E04B 1/10 52/693
6,477,817 B1 * 11/2002 Yurick ..... E04G 21/185 249/34
7,487,597 B2 * 2/2009 Diaz ..... E04B 1/4157 33/562
8,943,777 B2 * 2/2015 Espinosa ..... E02D 35/00 52/223.13
9,010,063 B2 * 4/2015 Spruiell ..... E04G 21/185 52/699
2002/0020136 A1 * 2/2002 Mueller ..... E04B 1/2604 52/712
2003/0068205 A1 * 4/2003 Augustine ..... E04B 2/825 405/303
2003/0101670 A1 * 6/2003 Gustin ..... E04G 17/12 249/34
2004/0068947 A1 * 4/2004 Commins ..... E04B 1/10 52/293.3
2005/0055897 A1 * 3/2005 Commins ..... E04H 9/14 52/169.1
2006/0000168 A1 * 1/2006 Compton ..... E04B 1/167 52/292
2012/0180423 A1 * 7/2012 Avila ..... E04H 9/021 52/700
2015/0167294 A1 * 6/2015 Ally ..... E04C 2/044 52/700
2016/0017594 A1 * 1/2016 Drummond ..... E04B 1/41 52/699
2016/0069065 A1 * 3/2016 Espinosa ..... E04B 1/4121 52/700

* cited by examiner

ANCHORAGE TEMPLATE FOR BUILDING WALLS AND METHOD

BACKGROUND OF THE INVENTION

Technical Field

The present application generally relates to light-framed wood and light-gauge steel building construction, and more particularly, to a sill plate anchorage assembly and related method for more quickly and efficiently erecting framed walls above concrete foundations for supporting pre-fabricated wall panelized construction.

State of the Art

Constructing buildings using pre-fabricated wall panels has become more popular both as a method of reducing construction costs and speeding construction. Such buildings often require a concrete foundation to which such pre-fabricated wall panels can be attached. In the past, there have been two primary techniques used to attach the base of such wall panels to the building foundation.

In one case, anchor bolts are set into the concrete foundation before the concrete pour; after the concrete cures, the upper ends of such anchor bolts are, at least in theory, received within pre-drilled mating mounting holes formed in the sill plates of the wall panels, and fasteners are then applied over the anchor bolts to secure the wall panels to the concrete foundation. In practice, it has been difficult, if not impractical, to ensure that the anchor bolts are positioned in the same pattern in which the receiving holes are formed in the pre-fabricated wall panels. Even if the anchor bolts are initially positioned accurately before the concrete pour begins, the process of pouring the concrete frequently displaces the anchor bolts from their initial positions. As a result, erectors of such buildings commonly find it necessary to drill out the bottom of the wall panels to match the actual spacing and position of the anchor bolts that extend upwardly from the concrete foundation. They also frequently find it necessary to remove and replace primary framing members from the wall panels in part or in entirety to match the positions of the anchor bolts. In addition, utility rough-ins such as for plumbing and electrical are often cast into the concrete in a manner that creates similar conflicts and repair necessity to the conflicting anchors. The need to perform this extra work requires extra time and slows construction.

In an alternate case, the task of setting the anchor bolts is delayed until after the concrete foundation has been cured. Holes are then drilled deep into the cured concrete footers with a hammer-drill or the like for receiving the anchor bolts. Thereafter, epoxy is applied within the drilled holes to fill the voids and secure the lower end of the anchor bolts within the concrete foundation. This process requires significant labor, is sensitive to weather conditions, and also requires extensive pull testing afterwards to confirm that the anchor bolts have been reliably set within the concrete foundation and that the epoxy has cured properly. Once again, construction is made more expensive and takes more time.

As noted above, utility rough-ins such as for plumbing and electrical are cast into the concrete before vertical wall panels are installed. These utility rough-ins are typically intended to extend into the vertical wall panels that are ultimately supported upon such concrete foundation. However, when the vertical wall panels are later attached, the locations of such utility rough-ins often interfere with framing elements already formed in a pre-fabricated vertical wall panel. By then, it is too late to move the location of the rough-ins since they are already fixed in the cured concrete. When this occurs, modifications to the pre-fabricated wall panel are required at the construction site. The need to perform this extra work likewise requires extra time and slows construction.

SUMMARY OF THE INVENTION

It is therefore an object of the present invention to provide an apparatus and method for anchoring prefabricated building walls to concrete foundations in a manner that reduces construction costs while speeding construction timeframes.

Another object of the present invention is to provide such an apparatus and method which avoids the need to align foundation anchoring bolts with the sill plates and framing members of pre-fabricated building walls.

Still another object of the present invention is to provide such an apparatus and method which avoids the need to modify the position of anchoring holes and framing members previously formed in the base portions of pre-fabricated building walls.

Yet another object of the present invention is to eliminate the need to drill holes into a cured concrete footer in order to receive anchor bolts used to secure base portions of pre-fabricated walls.

A further object of the present invention is to provide information to the various contractors, to-scale and in precise location, regarding the location of framing elements in order to enable utility rough-ins to be placed out-of-conflict with the individual elements of the pre-fabricated building walls.

A still further object of the present invention is to provide information to the various contractors to ensure that utility rough-ins are placed out-of-conflict with the individual framing elements of pre-fabricated building walls.

These and other objects of the present invention will become more apparent to those skilled in the art as the description of the present invention proceeds.

Briefly described, and in accordance with various embodiments thereof, a first aspect of the present invention relates to a sill plate anchorage assembly for supporting building walls, and including an elongated member having a number of spaced apertures formed therein. The elongated member is adapted to be releasably coupled to a concrete formwork that defines a space in which concrete will be poured for forming a foundation upon which the elongated member will be supported. A series of anchor shafts are provided, each extending between a lower end and an opposing upper end, and each such anchor shaft extends at least partially through a corresponding aperture in the elongated member. The lower end of each anchor shaft extends beyond the elongated member and is adapted to extend into the space defined by the concrete formwork. A corresponding series of fasteners are provided, each such fastener being adapted to engage the upper end of a corresponding anchor shaft. Upon pouring concrete into the concrete formwork, the lower ends of the anchor shafts become embedded within the concrete. After the concrete is cured, each such fastener is tightened over the upper end of a corresponding anchor shaft to secure the elongated member against the foundation.

In some embodiments of the invention, the aforementioned elongated member is temporarily secured to the concrete formwork before concrete is poured therein. In this manner, the elongated member is maintained at an elevation whereby the lower ends of the anchor shafts extend within the space in which concrete will be poured.

In at least some embodiments of the invention, each substantially-vertical aperture includes an enlarged recess extending below the uppermost surface of the elongated member, and wherein a fastener engages the upper end of a corresponding anchor shaft within such enlarged recess.

In various embodiments of the invention, the upper end of each anchor shaft has external threads, and the fastener is a nut for threadedly engaging the upper end of a corresponding anchor shaft. Tightening each nut over the upper end of its associated anchor shaft fastens the elongated member against the formed and cured concrete foundation in which the anchor shafts are embedded.

In some embodiments of the invention, at least one vertical wall panel has a base portion. A number of wall fasteners are provided, each such wall fastener extending through the base portion of the vertical wall panel and into the elongated member for securing the base portion of such vertical wall panel to the elongated member.

In some embodiments of the invention, the elongated member is marked with pertinent information to indicate the type and location of framing elements within a vertical wall panel that is to be secured over the elongated member after the concrete has been formed and cured. Such indicia may indicate the location and/or type of pass-through regions that extend within a vertical wall member to be supported upon the sill plate anchorage assembly.

In various embodiments of the invention, the elongated member is formed of wood, and the wall fasteners are threaded bolts.

In some embodiments, at least one vertical wall is a pre-fabricated building wall.

Another aspect of the present invention relates to a method of securing a horizontal sill plate to an underlying concrete foundation for supporting building walls. In various embodiments, such method includes forming a number of spaced apertures within an elongated member that forms the sill plate. A series of anchor shafts are extended within the plurality of apertures in a manner that allows the lower end of each such anchor shaft to extend below the elongated member. The upper end of each such anchor shaft is accessible from an upper surface of the elongated member. A concrete formwork is formed to define a space in which concrete will be poured for creating a concrete foundation upon which the elongated member will be supported. The elongated member is temporarily supported relative to the concrete formwork whereby the lower ends of the anchor shafts extend within the space in which concrete will be poured. Concrete is then poured into the concrete formwork, with the lower ends of the anchor shafts extending within the poured concrete, to form a concrete footer. After the concrete has cured, fasteners are secured to the upper ends of each anchor shaft for fastening the elongated member to the cured concrete foundation.

In various embodiments, the step of supporting the elongated member relative to the concrete formwork includes the step of temporarily securing the elongated member to a portion of the concrete formwork. The elongated member is removably coupled to the concrete formwork to facilitate removal of the formwork from the elongated member after the foundation has cured.

In various embodiments of such method, the step of forming a plurality of spaced apertures within the elongated member includes forming an enlarged recess extending below the uppermost surface of the elongated member. In some embodiments, the step of securing a fastener to the upper end of each anchor shaft includes positioning the fastener and upper end of the anchor shaft within such enlarged recess to avoid interference with the base portion of the vertical wall panel to be secured thereto.

In some embodiments of such method, the upper end of each anchor shaft is externally threaded, and the step of fastening the elongated member to the cured concrete foundation includes the steps of threadedly engaging a nut over the upper end of a corresponding anchor shaft, and tightening the nut thereover.

In various embodiments of practicing such method, at least one vertical wall panel is provided having a base portion. Wall fasteners are extended through the base portion of the vertical wall panel and into the elongated member for securing the base portion of such vertical wall to the elongated member.

In some embodiments of such method, the aforementioned vertical wall is fabricated remotely from the building site as a pre-fabricated wall.

Various embodiments of such method may also include the steps of forming markings upon the elongated member for indicating the location and/or type of an element within a building wall to be installed above the elongated member to guide contractors when locating elements that pass upwardly through the concrete foundation into a vertical wall supported above the elongated member.

The foregoing and other features and advantages of the present invention will become more apparent from the following more detailed description of particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein:

DETAILED DESCRIPTION

Figure 1:
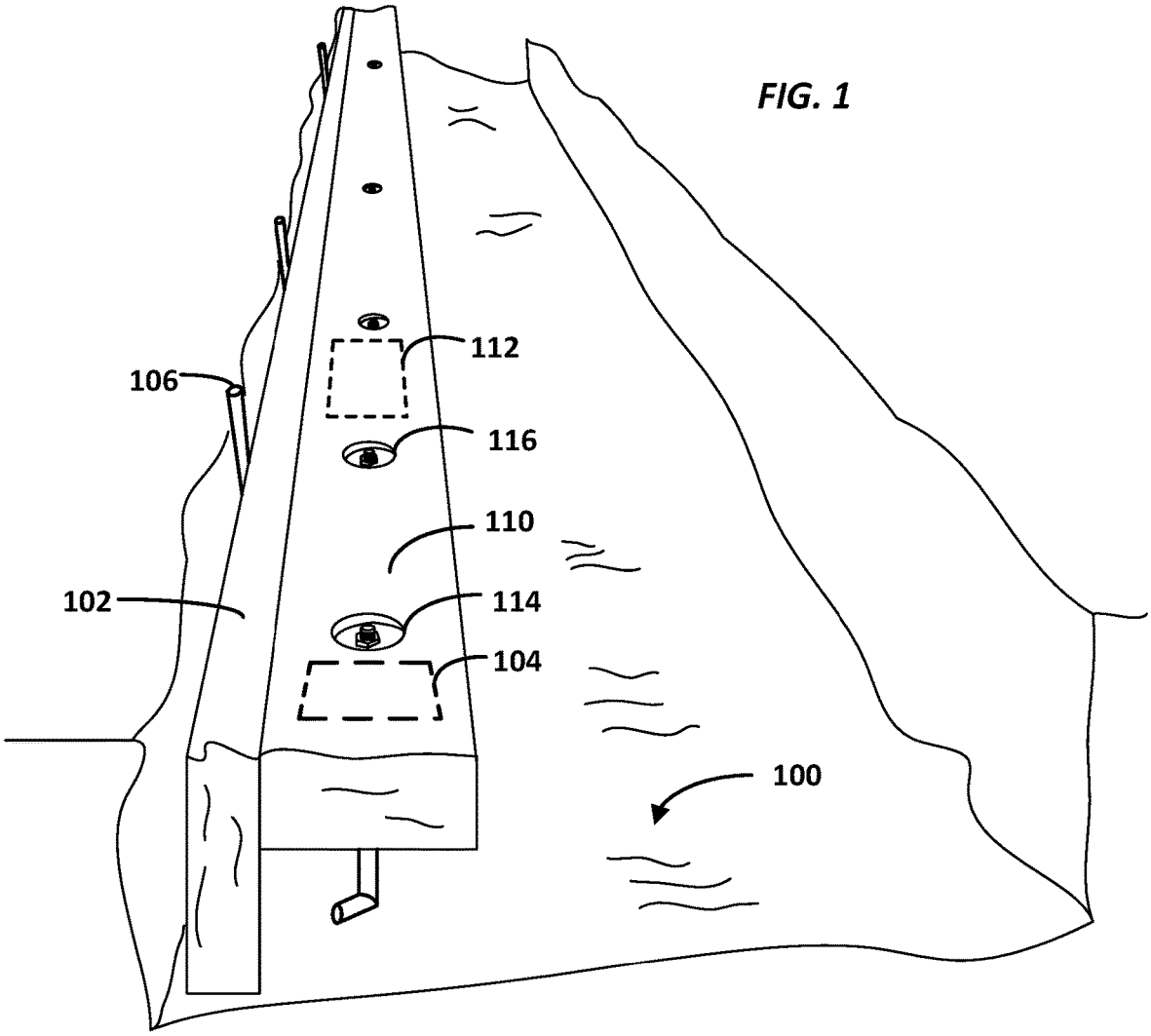
FIG. 1 is a perspective view of a concrete formwork configured to form a concrete foundation, and including a sill plate anchorage assembly in accordance with an embodiment of the present invention.

As shown in FIG. 1, a trench 100 has been excavated for receiving concrete (not shown) to form a concrete foundation for a building. A concrete formwork is formed, at least in part, by, for example, wooden board 102 which extends along one side of trench 100. In the example illustrated in FIG. 1, the lower floor and opposing wall of trench 100 also serve as part of the concrete formwork. Wooden board 102 may be supported at a desired elevation and at a desired lateral position with the aid of rebar members (106) pounded into trench 100. As used herein, a concrete foundation is intended to include, as well, a concrete slab or concrete footer.

Still referring to FIG. 1, an elongated member, or sill plate anchorage assembly, 110 extends along the upper portion of wooden board 102 adjacent the innermost face thereof. In the embodiment illustrated in FIG. 1, sill plate 110 is an elongated member, e.g., a wooden member that is five and one-half inches wide and approximately three and one-half inches thick. As will be described in greater detail below, sill plate 110 may be secured temporarily to wooden board 102 in order to support sill plate 110 at the proper height and position. In some embodiments, sill plate 110 is marked with pertinent information as may be helpful to enable fasteners, utility rough-ins, and other building elements to be placed out-of-conflict with elements to be installed atop sill plate 110. Such pertinent information may include locations and identifying information of individual framing elements that will extend within a framed wall subsequently installed above sill plate 110, for instance in a vertical wall panel, as will be explained herein. Referring to FIG. 1, regions 104 and 112 are marked by respective borders that are printed onto the upper surface of sill plate 110 to indicate pass-through regions that are vertically aligned with corresponding pass-through regions in a pre-fabricated wall. In this example, a plumbing contractor may use regions 104 and 112 as guides for drilling passages in sill plate 110 through which plumbing lines will pass. A plumbing contractor may then extend risers upwardly through such drilled holes, before the concrete is poured, thereby ensuring that such risers will properly mate with pre-fabricated walls that are later secured above sill plate 110. Marked regions 104 and 112 may be of different shapes or colors to indicate a certain type of pass-through region (e.g., water lines, gas lines, drain lines, electrical lines, fasteners, utility rough-ins, load transfer elements, etc.).

In one embodiment, wooden board 102 is one and one-half inches wide when set on edge as shown in FIG. 1. The temporary attachment of sill plate 110 to wooden board 102 may be, e.g., via nails or screws. This temporary attachment may be performed, if desired, at a factory, away from the construction site. Ideally, the lower surface of sill plate 110 should be supported at an elevation that corresponds to the upper surface of the concrete foundation to be formed. Also visible in FIG. 1 are a series of spaced recesses (114, 116) extending into the upper surface of sill plate 110, the purpose of which will be explained herein.

Figure 2:
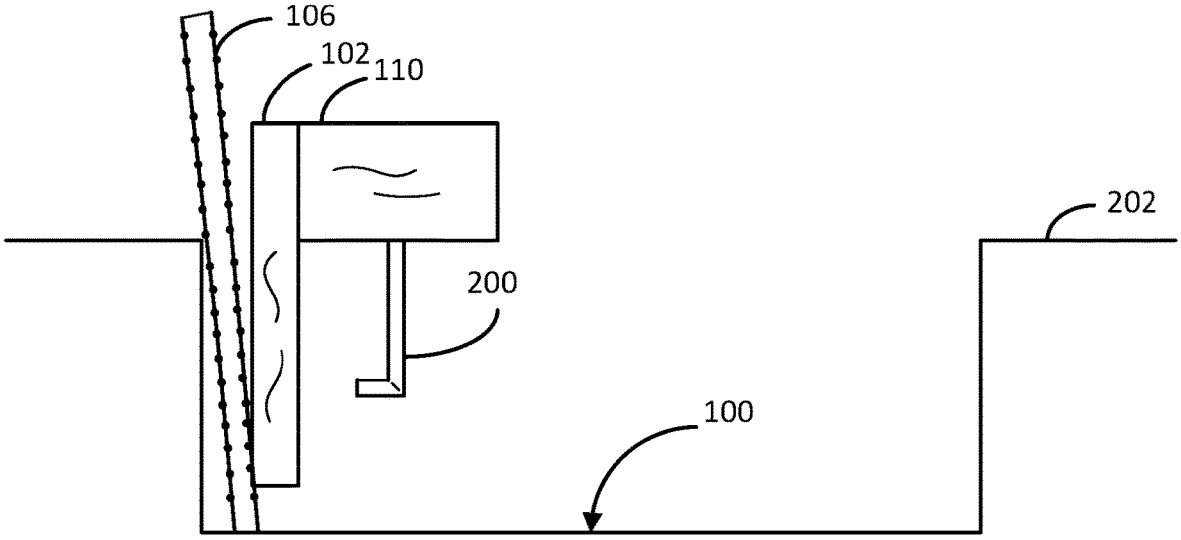
FIG. 2 is a front end view of the elements shown in FIG. 1 before the concrete pour is performed.

FIG. 2 is a front end view of the elements shown in FIG. 1 before the concrete pour is performed. Concrete will later be poured into trench 100 within the space bounded by wooden board 102 and trench 100 up to an elevation approximately the same as the elevation of the lower surface of sill plate 110. Extending from the lower surface of sill plate 110 are a series of spaced anchor shafts, one of which is visible as anchor shaft 200. The lower end of anchor shaft 200 is ultimately encased within the poured concrete foundation. In one embodiment of the invention shown in FIG. 2, the lower end of anchor shaft 200 extends at approximately a 90-degree angle from the main body of anchor shaft 200 to increase the pull-out resistance of anchor shaft 200. The number of such anchor shafts 200, and the spacing between such anchor shafts 200 per lineal foot of sill plate 110, can be varied to satisfy the engineering requirements specified for each individual construction project.

Figure 3:
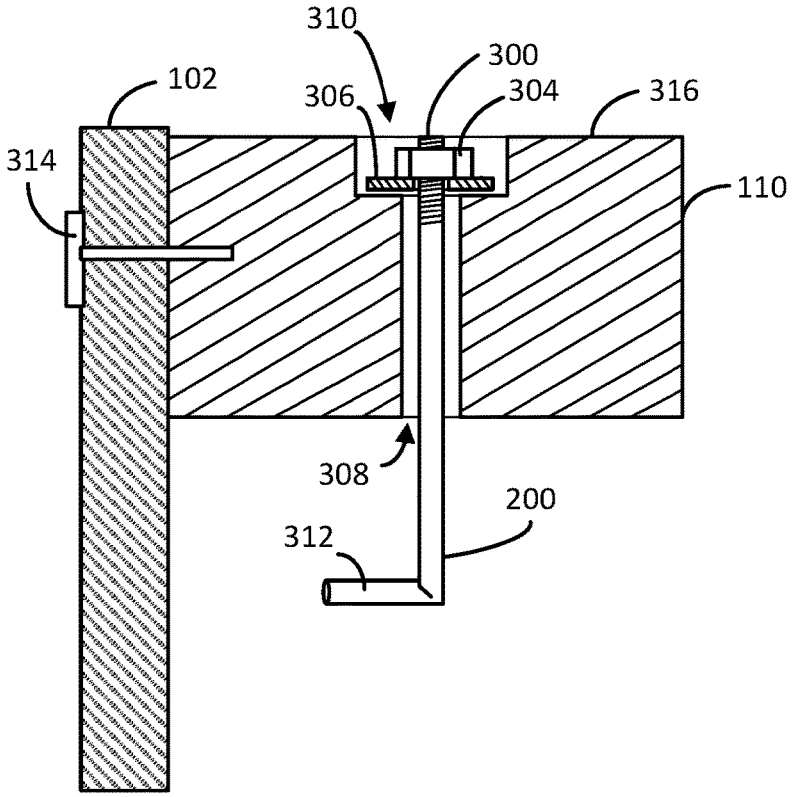
FIG. 3 is a cross-sectional diagram of a portion of the elements shown in FIG. 2, and showing temporary attachment of an elongated member of the sill plate anchorage assembly to a concrete formwork member, and further showing details of an anchoring shaft extending through an aperture formed in the elongated member.

FIG. 3 is a cross-sectional diagram of wooden board 102, sill plate 110, and anchor shaft 200 shown in FIG. 2, and illustrates the relationship of such components before concrete is poured. Sill plate 110 is temporarily secured to wooden board 102 by a number of fasteners 314, such as screws or nails. Following the concrete pour and after sufficient time has elapsed for concrete to at least partially cure to the extent required to maintain its shape, wooden member 102 and fasteners 314 may be removed, since sill plate 110 will, by then, be supported by the resulting concrete foundation. Anchor shaft 200 extends through cylindrical aperture 308 which extends generally vertically through sill plate 110; the diameter of aperture 308 is approximately equal to the diameter of anchor shaft 200. An enlarged recess 310 may be formed approximately concentric with aperture 308 and extending into sill plate 110 from its upper surface 316 to a depth at least equal to the length of the upper end 300 of anchor shaft 200 plus the depth of tightening nut 304 plus the depth of reinforcement washer 306. Cylindrical apertures 308 and associated recesses 310 are preferably pre-formed within sill plate 110 at a factory remote from the construction site.

In the embodiment illustrated in FIG. 3, the upper end 300 of anchor shaft 200 includes external threads for being engaged by a tightening nut 304. A reinforcement washer 306 may be inserted within recess 310 over upper end 300 of anchor shaft 200 below nut 304. Lower end 312 of anchor shaft 200 is shown extending laterally from the vertical axis of anchor shaft 200. Anchor shafts of this type are sometimes known as J-hooks, J-bolts, or L-shaped bolts. In some embodiments of the invention, anchor shafts 200, washers 306, and nuts 304 are loosely secured to sill plate 110 at a factory, remote from the construction site, whereby such elements are already in position when the elongated member is shipped to the construction site, i.e., before the concrete formwork is being assembled. Those skilled in the art will appreciate that, during the subsequent concrete pour operation, the concrete may be vigorously vibrated to remove entrapped air bubbles without concern for displacement of the anchor shafts (200); this is because anchor shafts 200 extend within apertures 308 formed in sill plate 110 and cannot readily be displaced therefrom. Vibration of the poured concrete is recommended to ensure that there are minimal voids in the concrete that is located directly below sill plate 110.

Figure 4:
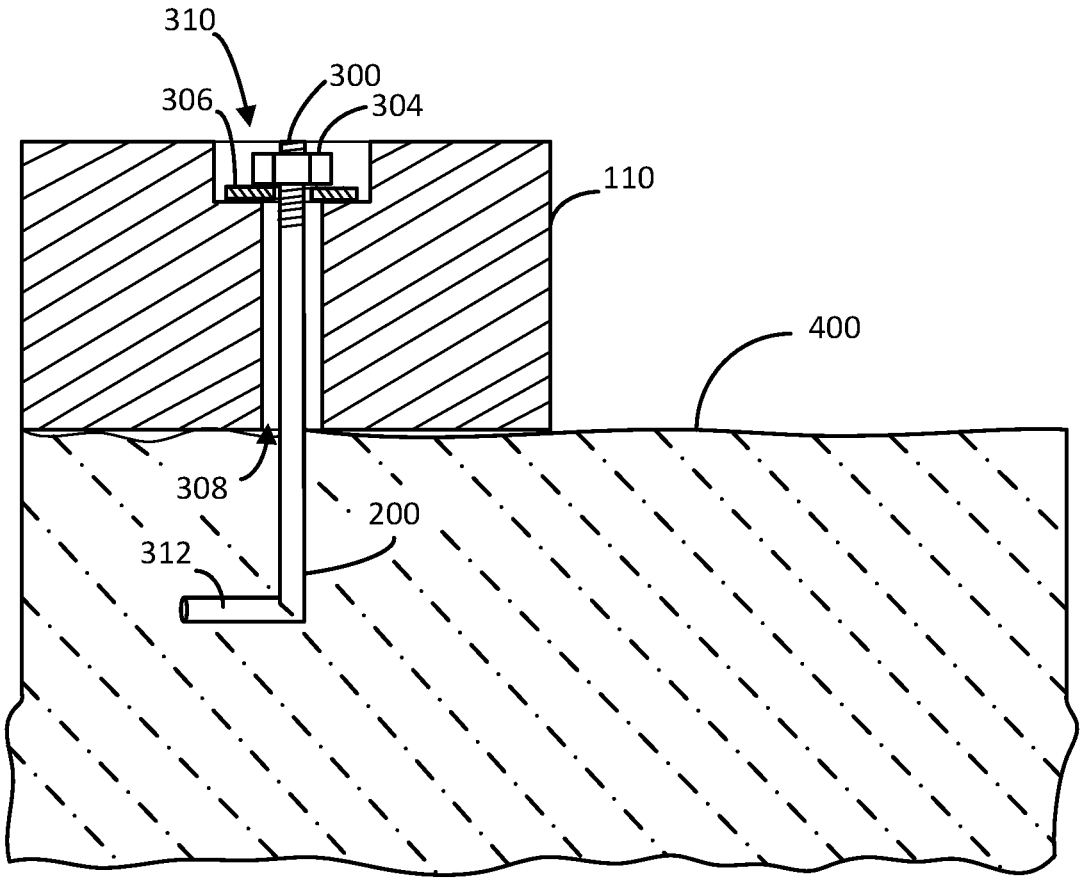
FIG. 4 is a sectional view similar to FIG. 3 but showing the resulting structure after the concrete has cured, and after the concrete formwork has been removed.

Turning now to FIG. 4, the resulting concrete foundation or slab 400 and attached sill plate are shown after the concrete pour, and after the concrete has cured. Once the concrete has cured, the concrete formwork provided by wooden board 102 may be removed. Lower end 312 of anchor shaft 200 is now firmly embedded within concrete foundation or slab 400. Nut 304 is securely tightened over the threaded upper end 300 of anchor shaft 200 to pull sill plate 110 firmly against the upper surface of concrete foundation or slab 400. While only one anchor shaft 200 is shown in the sectional view of FIG. 4, those skilled in the art will appreciate that similar anchor shafts may be provided at spaced intervals, e.g., every two feet, depending upon the engineering requirements of the building being constructed. As shown in FIG. 4, upon completion, upper end 300 of anchor shaft 200 and nut 304 are housed within enlarged recess 310 to avoid interference with the base portion of the vertical wall panel to be supported upon sill plate 110.

Figure 5:
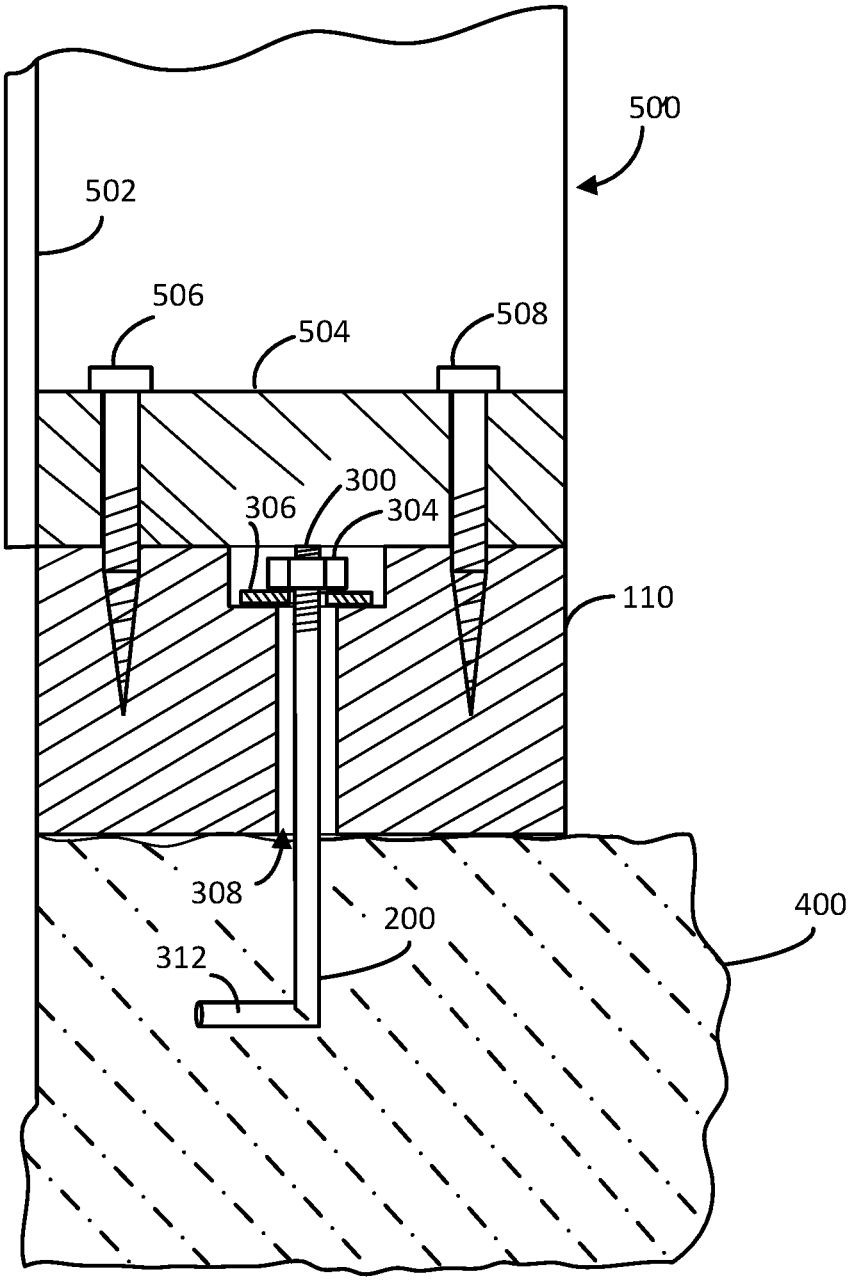
FIG. 5 is a cross-sectional view of the concrete foundation and attached sill plate anchorage assembly after the base portion of a vertical wall has been secured atop the elongated member of the sill plate anchorage assembly.

FIG. 5 is a cross-sectional view of the concrete foundation or slab 400 and attached horizontal sill plate 110 after the base portion of a vertical wall has been secured thereto. Wall panel 500, which may be a pre-fabricated wall element constructed off-site if desired, may include an exterior wall sheathing 502 and a lower base portion 504, and may include individual framing members of property, orientation and location as generally identified by the markings on sill plate 110. Base portion 504 may be one and one-half inches thick and five and one-half inches wide to match the width of sill plate 110. If desired, base portion 504 may have a series of mounting holes pre-formed therein for accepting fasteners such as lag bolts like those shown as 506 and 508. The aforementioned mounting holes can be formed off-site at a factory, if desired, and may be spaced at approximately regular intervals along base portion 504. Such mounting holes can serve as a template for drilling holes into sill plate 110 for receiving the lower ends of fasteners 506 and 508, which may be lag bolts or wood screws in some embodiments. Fasteners 506 and 508 may then be inserted into such mounting holes and tightened to firmly secure base portion 504 of wall panel 500 to sill plate 110. If desired, the positions of such mounting holes can be formed to correspond closely to the locations of the anchor shafts 200 in sill plate 110 directly below base portion 504 of wall panel 500 to better transfer stresses directly into the underlying foundation. It will be appreciated, however, that it is not necessary to form mounting holes within the base portions of the vertical wall panels to receive fasteners 506 and 508. Instead, self-tapping screws or similar fasteners may be used as fasteners 506 and 508 to effectively drill and tap through the base portion of the vertical wall panel and simultaneously thread into the underlying sill plate 110.

Figure 6:
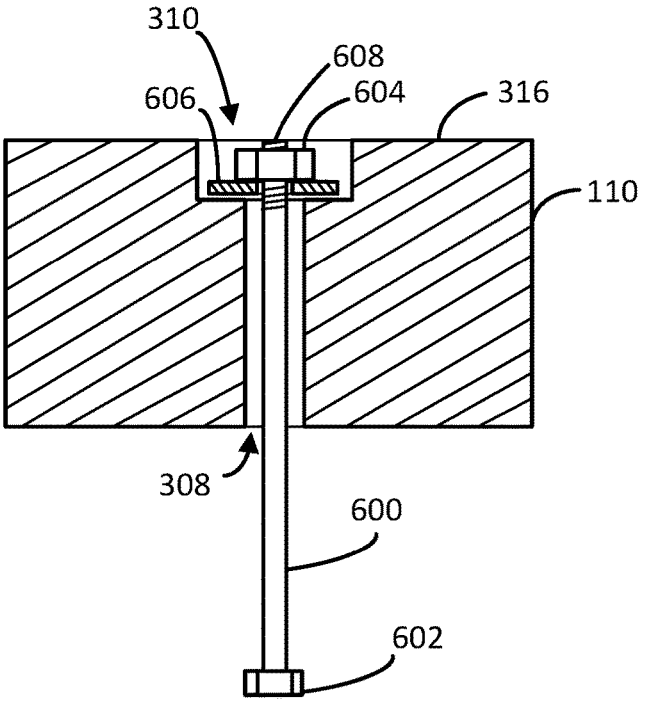
FIG. 6 is a cross-sectional diagram similar to that of FIG. 3 but showing a standard hex-head bolt as an anchor shaft instead of a J-hook or L-shaped bolt.

As shown in FIG. 6, the anchor shaft 600 may be a conventional hex-head bolt, with a lower hex-shaped head 602 and an upper threaded end 608 for engaging fastening nut 604, instead of the J-hook/L-shaped bolt shown in FIGS. 2 through 5. As an alternative, anchor shaft 600 could simply be a shaft having threads formed upon both its upper and lower ends, and a nut could be secured over the threaded lower end to take the place of the lowermost hex-shaped head shown in FIG. 6.

Figure 7:
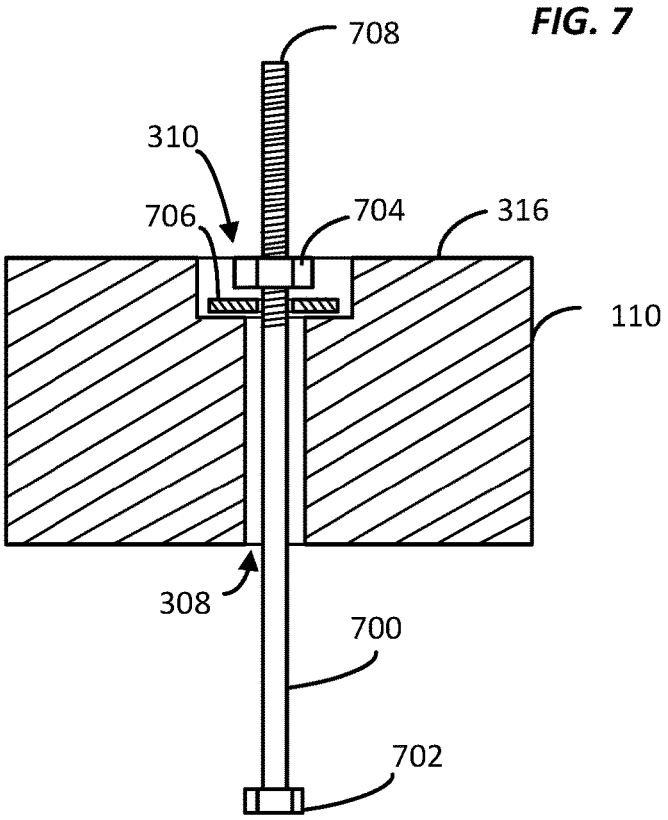
FIG. 7 is a cross-sectional diagram similar to that of FIG. 6 but showing an elongated threaded upper end for extending upwardly into a mating aperture of a building wall panel.

FIG. 7 shows an alternate embodiment, similar to FIG. 6, but wherein the threaded upper end 708 of anchor shaft 700 extends upwardly several inches above elongated member 110, and above fastener 704. After the concrete foundation is cured, fastener 704 is tightened over the upper end 708 of anchor bolt 700 to anchor sill plate 110 to the underlying foundation. In this embodiment, the remaining upper length of anchor shaft 700 that extends upwardly beyond sill plate 110 may be inserted into a pre-formed mating hole formed in the base portion of the vertical wall panel to be secured thereto. A second fastener, e.g., a nut, may then be secured over upper end 708 of anchor shaft 700 to secure the base portion of the vertical wall panel against sill plate 110. Using this embodiment, the fasteners 506 and 508 shown in FIG. 5 would no longer be needed to secure base portion 504 of wall panel 500 to elongated member 110.

Figure 8:
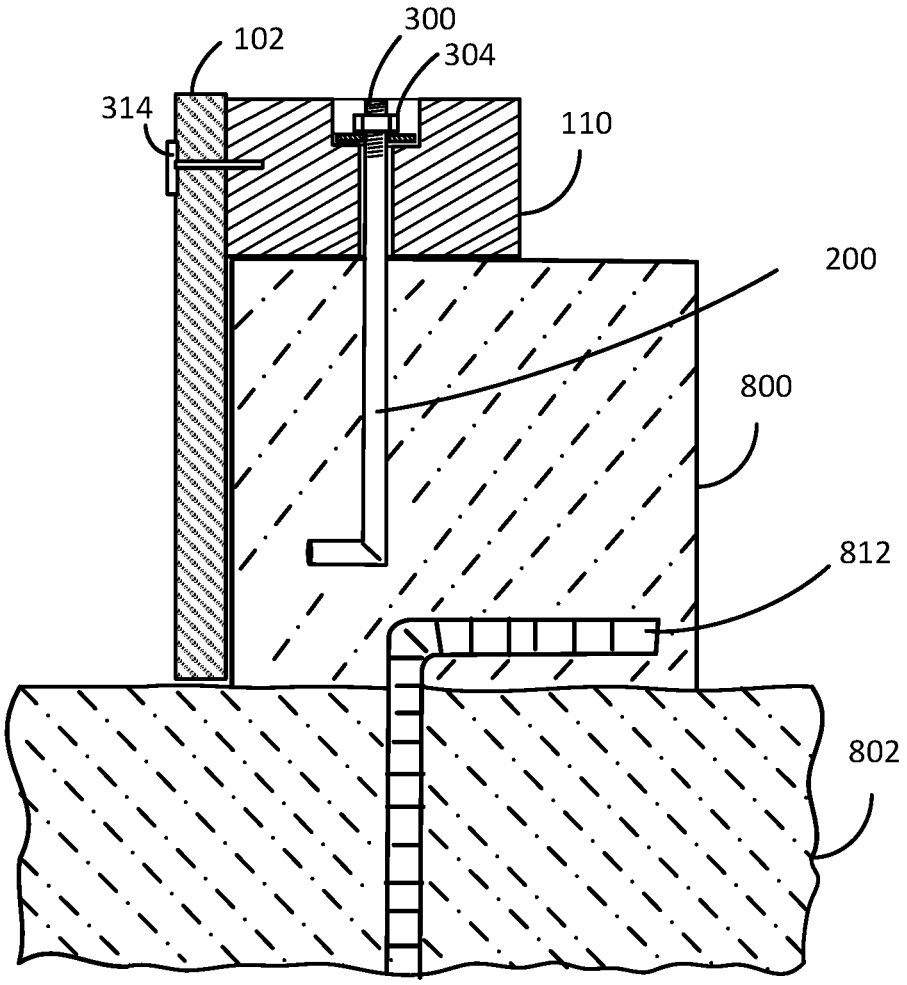
FIG. 8 is a cross-sectional diagram showing an alternate embodiment wherein the elongated member of the sill plate anchorage assembly is secured to a concrete slab which, in turn, is poured over a larger concrete foundation.

FIG. 8 shows an alternate embodiment of the invention wherein a concrete foundation 802 is formed in a first step. During the pour of concrete foundation 802, one or more steel reinforcing bars 812 are inserted into the concrete before it is cured, with the angled upper ends of such rebar members 812 extending above. In a second step, at those locations where vertical walls are to be supported, a concrete formwork, including member 102 is formed to define a space in which a narrower upper concrete curb or slab 800 is to be formed. Sill plate 110 is temporarily secured to concrete formwork member 102, as by fasteners 314. Anchor shafts 200 extend downwardly from sill plate 110 through spaced holes formed therein, and fasteners 304 are loosely secured over the upper ends 300 of anchor shafts 200. Concrete is then poured within the formwork to create concrete footer 800. The upper ends of rebar members 812 become embedded in concrete curb or slab 800, effectively anchoring concrete curb or slab 800 to the underlying concrete foundation 802. Likewise, the lower ends of anchor shafts 200 become embedded in concrete curb or slab 800. After concrete curb or slab 800 has cured, formwork 102 may be removed from sill plate 110, nut 304 is tightened over the upper end 300 of anchor shaft 200, and sill plate 110 is now ready to be used for attachment of a vertical wall panel thereto.

Those skilled in the art will appreciate that, while sill plate 110 has been described as being formed as a wooden member, other materials may be used to form sill plate 110, including steel or other metals. Likewise, while concrete formwork member 102 has been described as a wooden board, this member may be formed from other materials, including composites, steel or other metals, and may not always also be used to define the space in which the concrete is poured. Also, while wall panels 500 have been described above as pre-fabricated wall panels, it will be appreciated that such wall framing may, if desired, be constructed at the job site and secured to corresponding sill plates following the pouring and curing of the concrete footers.

It will be recognized that an apparatus and method have now been described for supporting prefabricated building walls upon concrete footers in a manner that reduces construction costs while speeding construction. The described apparatus and method eliminate any need to align foundation anchoring bolts with the base portions of pre-fabricated building walls, thereby avoiding any need to modify the position of anchoring holes previously formed in the base portions of pre-fabricated building walls to accommodate anchor shafts that shifted out of position during the concrete pour. Likewise, the described apparatus and method do away with the need to drill any holes into a cured concrete footer in order to receive anchor bolts for securing base portions of pre-fabricated walls to the concrete footer.

The embodiments specifically illustrated and/or described herein are provided merely to exemplify particular applications of the invention. These descriptions and drawings should not be considered in a limiting sense, as it is understood that the present invention is in no way limited to only the disclosed embodiments. It will be appreciated that various modifications or adaptations of the methods and or specific structures described herein may become apparent to those skilled in the art. All such modifications, adaptations, or variations are considered to be within the spirit and scope of the present invention, and within the scope of the appended claims.

I claim:

1. A method of securing a sill plate anchorage assembly to an underlying concrete foundation for supporting building walls, said method comprising the steps of:

a) forming a plurality of substantially vertical spaced apertures within an elongated member, the elongated member including an uppermost surface, wherein the step of forming the plurality of substantially vertical spaced apertures within the elongated member includes forming an enlarged recess extending around the upper end of each substantially vertical spaced aperture and extending below the uppermost surface of the elongated member;

b) inserting a plurality of anchor shafts within the plurality of substantially vertical spaced apertures, wherein the lower end of each of said plurality of anchor shafts extends below the elongated member, and wherein the upper end of each of said plurality of anchor shafts is accessible from the uppermost surface of the elongated member;

c) securing a fastener over the upper end of each of said plurality of anchor shafts for allowing each of said plurality of anchor shafts to be suspended from the elongated member;

d) forming a concrete formwork to define a space in which concrete will be poured for forming a concrete foundation upon which the elongated member will be supported;

e) supporting the elongated member relative to the concrete formwork whereby each of said plurality of anchor shafts is suspended from the elongated member, and whereby the lower ends of the anchor shafts extend within the space in which concrete will be poured;

f) pouring concrete into the concrete formwork, with the lower ends of the anchor shafts extending within the poured concrete, to form a concrete foundation;

g) after the concrete has cured, securely tightening the fastener to the upper end of each anchor shaft for fastening the elongated member to the cured concrete foundation, the fastener and the upper end of the anchor shaft being contained within the enlarged recess of the substantially vertical spaced aperture in which each anchor shaft is inserted.

2. The method recited by claim 1 wherein the step of supporting the elongated member relative to the concrete formwork includes the step of temporarily securing the elongated member to a portion of the concrete formwork.

3. The method recited by claim 1 wherein the upper end of each anchor shaft has external threads, wherein the fastener is a nut for threadedly engaging the upper end of a corresponding anchor shaft, and wherein the step of securely tightening the fastener to the upper end of an anchor shaft includes tightening the nut over the upper end of the anchor shaft for fastening the elongated member to the cured concrete foundation.

4. The method recited by claim 1 including the step of forming markings upon the elongated member for indicating a location of an element within a building wall to be installed above the elongated member.

5. The method recited by claim 4 wherein the step of forming markings includes formation of indicia which identify a specific type of framing element within the building wall to be installed above the elongated member.

6. A method of securing a sill plate anchorage assembly to an underlying concrete foundation for supporting building walls, said method comprising the steps of:

a) forming a plurality of spaced apertures within an elongated member, the elongated member including an uppermost surface;

b) inserting a plurality of anchor shafts within the plurality of spaced apertures, wherein the lower end of each of said plurality of anchor shafts extends below the elongated member, and wherein the upper end of each of said plurality of anchor shafts is accessible from an upper surface of the elongated member;

c) securing a fastener over the upper end of each of said plurality of anchor shafts for allowing each of said plurality of anchor shafts to be suspended from the elongated member;

d) forming a concrete formwork to define a space in which concrete will be poured for forming a concrete foundation upon which the elongated member will be supported;

e) supporting the elongated member relative to the concrete formwork whereby each of said plurality of anchor shafts is suspended from the elongated member, and whereby the lower ends of the anchor shafts extend within the space in which concrete will be poured;

f) pouring concrete into the concrete formwork, with the lower ends of the anchor shafts extending within the poured concrete, to form a concrete foundation;

g) after the concrete has cured, securely tightening the fastener to the upper end of each anchor shaft for fastening the elongated member to the cured concrete foundation;

h) providing a vertical wall panel having a base portion, the base portion of the vertical wall panel having a lowermost surface; and i) extending a plurality of wall fasteners generally vertically through the base portion of the vertical wall panel and into the elongated member for securing the lowermost surface of the base portion of the vertical wall panel to the uppermost surface of the elongated member.

7. The method recited by claim 6 wherein the elongated member includes an uppermost surface, and wherein the step of forming a plurality of spaced apertures within the elongated member includes forming an enlarged recess extending below the uppermost surface of the elongated member for each of said plurality of spaced apertures.

8. The method recited by claim 7 wherein the step of securely tightening a fastener to the upper end of each anchor shaft includes positioning the fastener and upper end of the anchor shaft within the enlarged recess of the spaced aperture in which the anchor shaft is installed.

9. The method recited by claim 6 wherein the step of pouring concrete into the concrete formwork is performed at a building site, and wherein the method includes the further step of fabricating the vertical wall panel remotely from the building site as a pre-fabricated wall.

* * * * *